US008998149B2

(12) United States Patent
Takahashi et al.

(10) Patent No.: US 8,998,149 B2
(45) Date of Patent: Apr. 7, 2015

(54) GROUND DEVICE FOR TRAIN CONTROL SYSTEM

(71) Applicant: The Nippon Signal Co., Ltd., Tokyo (JP)

(72) Inventors: Masahide Takahashi, Kuki (JP); Naoto Hashimoto, Kuki (JP)

(73) Assignee: The Nippon Signal Co., Ltd., Tokyo (JP)

( * ) Notice: Subject to any disclaimer, the term of this patent is extended or adjusted under 35 U.S.C. 154(b) by 0 days.

(21) Appl. No.: 14/227,596

(22) Filed: Mar. 27, 2014

(65) Prior Publication Data

US 2014/0209753 A1 Jul. 31, 2014

Related U.S. Application Data

(63) Continuation of application No. PCT/JP2012/074418, filed on Sep. 24, 2012.

(30) Foreign Application Priority Data

Sep. 30, 2011 (JP) ..... 2011-217316

(51) Int. Cl.
*B61L 23/34* (2006.01)
*B61L 3/00* (2006.01)
(Continued)

(52) U.S. Cl.
CPC ..... *B61L 3/008* (2013.01); *B61L 27/0061* (2013.01); *B61L 3/125* (2013.01); *B61L 3/227* (2013.01)

(58) Field of Classification Search
CPC ..... B61L 27/00; B61L 3/12; B61L 25/02
USPC ..... 246/2, 2 S, 2 R, 4, 6, 122 R, 167 R, 29 R
See application file for complete search history.

(56) References Cited

U.S. PATENT DOCUMENTS 4,532,511 A * 7/1985 Lemelson ..... 340/933
7,201,350 B2 * 4/2007 Sugita et al. ..... 246/122 R
(Continued)

FOREIGN PATENT DOCUMENTS

JP 2000-289615 A 10/2000
JP 2002-240715 A 8/2002
(Continued)

*Primary Examiner* — Jason C Smith
(74) *Attorney, Agent, or Firm* — Foley & Lardner LLP

(57) ABSTRACT

A ground device 1 transmits train control information to an on-board device mounted on a train. The ground device 1 receives a train detection signal (TD signal) from a train with an ATC/TD on-board device mounted thereon through loop coils $\mathbf{2}_1$ to $\mathbf{2}_m$, and receives a train position signal from a train with a CBTC on-board device mounted thereon through way-side radio sets $\mathbf{6}_1$ to $\mathbf{6}_n$. Based on the input train detection signal and train position signal, the ground device 1 detects the position of each train traveling on a route R, generates control information on each train based on the detected position of each train, and converts the control information to an ATC signal and a CBTC signal. The ATC signal is transmitted to the loop coils $\mathbf{2}_1$ to $\mathbf{2}_m$ through information transmission units 4, and the CBTC signal is transmitted through the way-side radio sets $\mathbf{6}_1$ to $\mathbf{6}_n$.

6 Claims, 3 Drawing Sheets

(51) Int. Cl.

| | |
|---|---|
| ***B61L 27/00*** | (2006.01) |
| *B61L 3/12* | (2006.01) |
| *B61L 3/22* | (2006.01) |

(56) References Cited

U.S. PATENT DOCUMENTS

| | | | | |
|---|---|---|---|---|
| 7,742,849 | B2 * | 6/2010 | Muinonen et al. | 701/19 |
| 7,983,806 | B2 * | 7/2011 | Muinonen et al. | 701/19 |
| 8,239,080 | B2 * | 8/2012 | Chun | 701/19 |
| 2005/0133673 | A1 * | 6/2005 | Sugita et al. | 246/167 R |
| 2008/0068164 | A1 * | 3/2008 | Campbell | 340/572.1 |
| 2011/0186692 | A1 * | 8/2011 | Kumar et al. | 246/29 R |
| 2013/0193276 | A1 * | 8/2013 | Hunter | 246/122 R |
| 2013/0248658 | A1 * | 9/2013 | Takagi | 246/122 R |
| 2014/0012438 | A1 * | 1/2014 | Shoppa et al. | 701/19 |
| 2014/0042279 | A1 * | 2/2014 | Kadono et al. | 246/167 R |
| 2014/0054424 | A1 * | 2/2014 | Xu et al. | 246/122 R |
| 2014/0103166 | A1 * | 4/2014 | Asuka et al. | 246/4 |
| 2014/0131524 | A1 * | 5/2014 | Grimm et al. | 246/3 |
| 2014/0138495 | A1 * | 5/2014 | Lostun et al. | 246/219 |
| 2014/0172205 | A1 * | 6/2014 | Ruhland et al. | 701/19 |

FOREIGN PATENT DOCUMENTS

| | | | |
|---|---|---|---|
| JP | 2003-034249 | A | 2/2003 |
| JP | 2005-206100 | A | 8/2005 |
| JP | 2008-162548 | A | 7/2008 |
| JP | 2010-036803 | A | 2/2010 |
| JP | 2010-076653 | A | 4/2010 |
| WO | WO 2011/021544 | A1 | 2/2011 |

* cited by examiner

GROUND DEVICE FOR TRAIN CONTROL SYSTEM

This application is a continuation application of PCT/JP2012/074418, filed on Sep. 24, 2012.

BACKGROUND OF THE INVENTION

1. Field of the Invention

The present invention relates to a train control system, and particularly to a ground device that transmits train control information to an on-board device mounted on a train to control the speed and the like of the train.

2. Description of Related Art

Train control systems are configured such that an on-board device mounted on a train controls the speed and the like of the train based on a train control signal received from a ground device to ensure the safe traveling of the train. As such train control systems, various systems have been conventionally proposed (refer to Japanese Laid-Open Patent Application Publication No. 2010-36803, Japanese Laid-Open Patent Application Publication No. 2008-162548).

Conventionally, one train control system has been applied to one train line (zone), and trains on which on-board devices for train control systems of respectively different types are mounted have not been able to travel on a route within the same train line (zone). This is because the structure for detecting the position of a train, the kind of train position information, and the like are different depending on the type of train control system, and train position information and the like cannot be shared between train control systems of different types. This is also because an on-board device can receive a train control signal only from a ground device for a train control system of the same type and hence safe traveling within a train line (zone) cannot be ensured.

With the development of railroad networks, the need to permit trains on which on-board devices for train control systems of respectively different types are mounted to enter part of a train line or a specific zone may arise. However, it is difficult for the conventional techniques to meet such a need.

Furthermore, when an existing system is changed to a new system, there is a need to achieve a balance between commercial operations by the existing system and the adjustment of the new system during the transition. Therefore, upon changing the system, after a ground device for the new system is installed, an on-board device for the new system must be added to trains with an on-board device for the existing system mounted thereon, and after the completion of the adjustment of the new system, the on-board device for the existing system must be removed. In other words, the vehicles need to be altered at least twice, and this requires much time and effort at system change.

SUMMARY OF THE INVENTION

The present invention has been made in view of such situations, and it is an object thereof to provide a ground device capable of detecting the position of each train in the same train line (zone) even when trains travel through the train line (zone), where on-board devices for train control systems of respectively different types are mounted on the trains, and transmitting a train control signal to each train.

A ground device according to one aspect of the present invention transmits a train control signal for a train to an on-board device mounted on the train. This ground device includes an input unit capable of inputting first train position information and second train position information different in kind from each other, a processing unit that detects the position of each train traveling on a route based on the input first train position information and second train position information, generates control information on each train based on the detected position of the train, and converts the generated control information to a first train control signal and a second train control signal different in kind from each other, and a transmitting unit that transmits the first train control signal and the second train control signal.

The ground device mentioned above inputs first train position information and second train position information different in kind from each other, detects the position of each train traveling within a specific zone, generates control information on each train based on the detected position of the each train, coverts the control information to a first train control signal and a second train control signal different in kind from each other, and transmits the first train control signal and the second train control signal. This allows trains with on-board devices for train control systems different from each other mounted thereon to travel safely within the specific zone.

Furthermore, the ground device mentioned above is used upon changing a train control system to another, and this avoids the need to alter the trains or reduces the number of alterations, reducing time and effort significantly at system change compared with the conventional one.

DESCRIPTION OF THE PREFERRED EMBODIMENTS

First, a summary of the present invention will be described.

The present invention provides a novel ground device for train control systems. The ground device according to the present invention allows trains to travel safely through the same train line or zone, where on-board devices for train control systems of respectively different types and/or using different kinds of signals are mounted on the trains.

An embodiment of the present invention will be described below with reference to the accompanying drawings.

Figure 1:
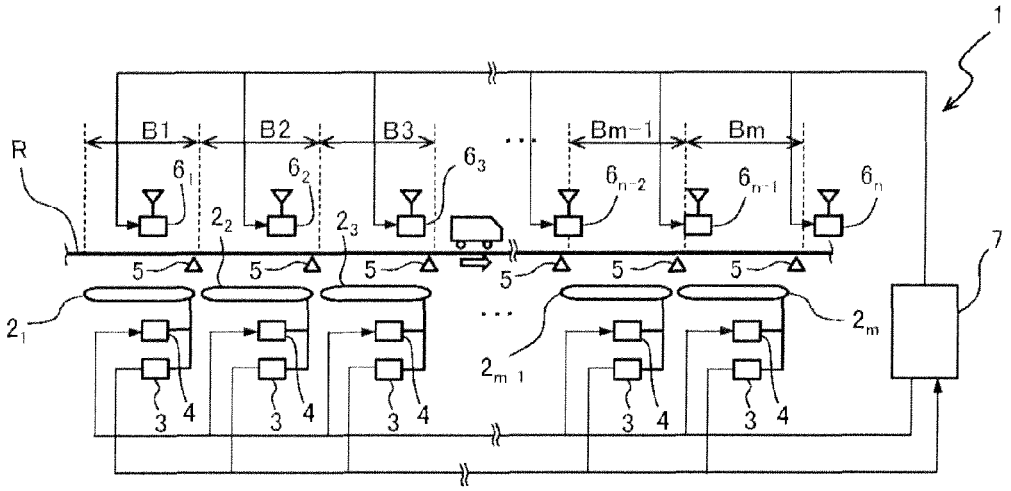
FIG. 1 is a diagram illustrating an example of a ground device according to an embodiment of the present invention.

FIG. 1 illustrates an example of a ground device according to the embodiment of the present invention. This ground device 1 is applied to a route R that permits the traveling of a train on which an on-board device for an ATC/TD system (hereinafter called "ATC/TD on-board device") for performing train control by a fixed block system is mounted and the traveling of a train on which an on-board device for a CBTC system (hereinafter called "CBTC on-board device") for performing train control by a moving block system using radio.

As illustrated in FIG. 1, a ground device 1 includes multiple loop coils $\mathbf{2}_1$ to $\mathbf{2}_m$, train detection units 3 and information transmission units 4, each of which is connected to each of the loop coils, multiple ground coils 5, multiple wayside radio sets $\mathbf{6}_1$ to $\mathbf{6}_n$, and a control unit 7.

The loop coils $\mathbf{2}_1$ to $\mathbf{2}_m$ are installed along a route R to correspond to respective multiple fixed sections B1 to Bm obtained by dividing the route R. Here, though loop coils are used, track circuits may be used instead of the loop coils.

Each of the train detection units 3 detects whether a train is present on rails in a corresponding fixed section based on a train detection signal (TD signal) transmitted from the train traveling on the route R to a corresponding loop coil. The detection result of each of the train detection units 3, i.e., the presence or absence of an on-rail train in each fixed section is output to the control unit 7.

When track circuits are used instead of the loop coils, for example, the train detection unit 3 is made up of a transmission unit that transmits signal current for train detection to each of the track circuits and a receiving unit that receives the signal current, to detect the presence of an on-rail train based on the signal current.

Each of the information transmission units 4 is controlled by the control unit 7 to transmit a train control signal (hereinafter simply called "ATC signal") including stop section information indicative of a section (any of fixed sections B1 to Bm) in which the train is to stop to one or more corresponding loop coils. The stop section information and the ATC signal will be described later.

Each of the ground coils 5 is installed near the border between adjacent fixed sections (or loop coils) along the route R. The ground coil 5 is, for example, made up of a transponder, and electromagnetically coupled to an on-board coil of a train traveling on the route R to transmit and receive signals. In the embodiment, the ground coil 5 transmits a signal (hereinafter simply called "position signal") including position information indicative of a position on the route R to the on-board coil of the train.

Each of the wayside radio sets $\mathbf{6}_1$ to $\mathbf{6}_n$ are installed at predetermined intervals along the route R. Like the ground coil 5, each of the wayside radio sets $\mathbf{6}_1$ to $\mathbf{6}_n$ may be installed near the border between adjacent fixed sections (or loop coils). Each of the wayside radio sets $\mathbf{6}_1$ to $\mathbf{6}_n$ has an antenna to transmit and receive radio signals to and from a vehicle radio set of a train traveling on the route R. Each of the wayside radio sets $\mathbf{6}_1$ to $\mathbf{6}_n$ receives a train position signal (radio signal) indicative of the position of the train from the vehicle radio set of the train, and outputs the received train position signal to the control unit 7. Furthermore, each of the wayside radio sets $\mathbf{6}_1$ to $\mathbf{6}_n$ is controlled by the control unit 7 to transmit a train control signal (hereinafter simply called "CBTC signal") including stop limit information indicative of a limit, to which the train can travel, to the vehicle radio set. The stop limit information indicates a stop position at which the train is to stop, which includes a position that can ensure a safe distance (interval) from the preceding train, for example. This safe distance can be set appropriately according to the conditions of the route R, and the like. The stop limit information and the CBTC signal will be described later.

Each of the wayside radio sets $\mathbf{6}_1$ to $\mathbf{6}_n$ performs radio communication with adjacent wayside radio sets to enable the transmission of information while relaying the information. The interval between wayside radio sets just has to be set so that each other's signal transmission ranges will overlap, but the wayside radio sets are preferably installed at an interval capable of transmitting the signal up to the wayside radio set after the next.

The detection result of each of the train detection units 3 and the train position signal received by each of the wayside radio sets $\mathbf{6}_1$ to $\mathbf{6}_n$ are input to the control unit 7, and based on the input information, the control unit 7 detects the position of each train traveling on the route R. The control unit 7 generates control information on each train based on the detected position of each train. Then, the control unit 7 converts the generated control information to the ATC signal and outputs the ATC signal to each of the information transmission units 4, while the control unit 7 converts the generated control information to the CBTC signal and outputs the CBTC signal to each of the wayside radio sets $\mathbf{6}_1$ to $\mathbf{6}_n$. The details of processing performed by the control unit 7 will be described later (see FIG. 4).

Here, trains traveling on the route R will be described.

Figure 2:
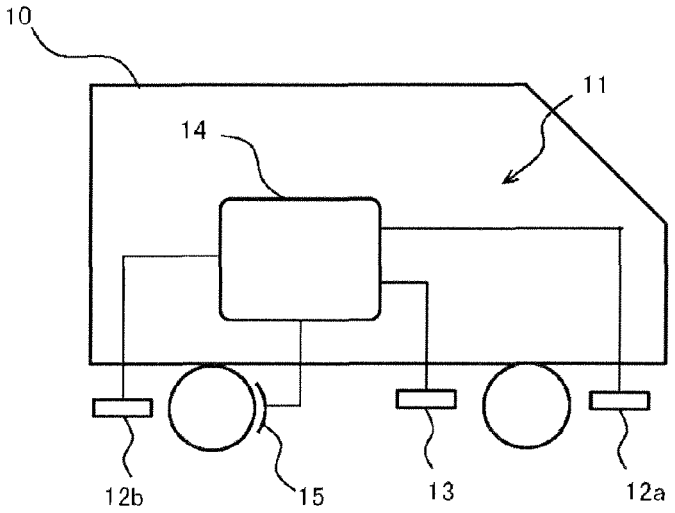
FIG. 2 is a diagram illustrating a train traveling on a route to which the ground device according to the embodiment is applied, and a structural example of an on-board device thereof.
Figure 3:
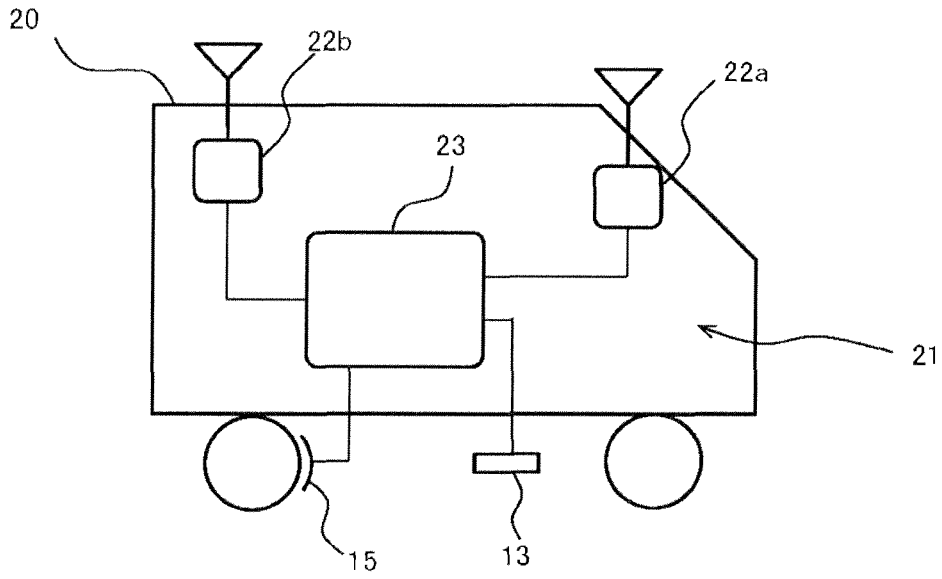
FIG. 3 is a diagram illustrating another train traveling on the route to which the ground device according to the embodiment is applied, and another structural example of an on-board device thereof.

FIGS. 2 and 3 illustrate trains traveling on the route R to which the ground device 1 is applied, and structural examples of on-board devices thereof. FIG. 2 illustrates a train 10 on which an ATC/TD on-board device is mounted, and FIG. 3 illustrates a train 20 on which a CBTC on-board device is mounted.

As illustrated in FIG. 2, an ATC/TD on-board device 11 is mounted on the train 10. This ATC/TD on-board device 11 includes ATC/TD antennas 12*a* and 12*b*, an on-board coil 13, and an ATC control unit 14.

The ATC/TD antennas 12*a* and 12*b* are provided in front and rear bottom portions of the train 10. The ATC/TD antennas 12*a* and 12*b* are electromagnetically coupled to one or more corresponding loop coils of ground-side loop coils $\mathbf{2}_1$ to $\mathbf{2}_m$ to receive the ATC signal from the corresponding loop coils and to transmit, for example, a train head signal and a train tail signal as the TD signals to the corresponding loop coils. Here, the ATC signal is generally received by an ATC/TD antenna located on the front side in the traveling direction of the train 10.

The on-board coil 13 is provided in a bottom portion of the train 10, and electromagnetically coupled to each of the ground coils 5 to receive the position signal from the ground coil 5.

The ATC signal and the position signal are input to the ATC control unit 14, and speed information on the train 10 is input to the ATC control unit 14 from a speed generator (speed detector) 15 attached to a wheel of the train 10. The ATC control unit 14 detects the position and speed of the train 10 based on position information included in the position signal and the speed information. Then, the ATC control unit 14 creates a speed check pattern based on the detected position and speed of the train 10, stop section information included in the ATC signal, the brake performance of the train 10, and the like, to perform brake control based on the speed check pattern in order to control the speed of the train 10.

Furthermore, as illustrated in FIG. 3, a CBTC on-board device 21 is mounted on the train 20. This CBTC on-board device 21 includes vehicle radio sets 22*a* and 22*b*, an on-board coil 13, and a CBTC control unit 23.

Each of the vehicle radio sets 22*a* and 22*b* has an antenna provided on the top of the train 20 to receive the CBTC signal from each of the wayside radio sets $\mathbf{6}_1$ to $\mathbf{6}_n$. Furthermore, the vehicle radio set 22*a*, 22*b* sends the position of the train 20 detected by the CBTC control unit 23 toward the wayside radio sets $\mathbf{6}_1$ to $\mathbf{6}_n$ as the train position signal. Here, the vehicle radio set 22*a* installed in a front portion of the train 20 and the vehicle radio set 22*b* installed in a rear portion of the train 20 can transmit and receive radio signals to and from different wayside radio sets, respectively.

The on-board coil 13 is provided in a bottom portion of the train 20, and electromagnetically coupled to each of the ground coils 5 to receive the position signal from the ground coil 5.

The CBTC signal and the position signal are input to the CBTC control unit 23, and speed information on the train 20 is input to the CBTC control unit 23 from the speed generator (speed detector) 15 attached to a wheel of the train 20. The CBTC control unit 23 detects the position and speed of the train 20 based on position information included in the position signal and the speed information. The position of the train 20 can also be calculated based on the signal propagation time between each of the vehicle radio sets 22*a*, 22*b* and each of the wayside radio sets $\mathbf{6}_1$ to $\mathbf{6}_n$. Then, the CBTC control unit 23 outputs the detected position of the train 20 to the vehicle radio sets 22*a* and 22*b*, and creates a speed check pattern based on the detected position and speed of the train 20, stop limit information included in the CBTC signal, the brake performance of the train 20, and the like, to perform brake control based on the speed check pattern in order to control the speed of the train 20.

Next, the configuration of the control unit 7 in the ground device 1 and processing performed by the control unit 7 will be described.

Figure 4:
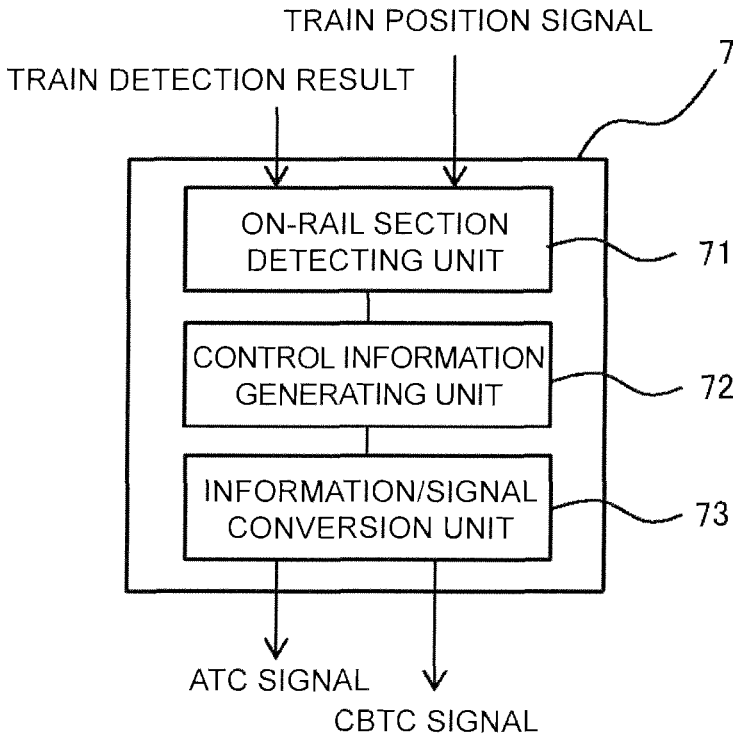
FIG. 4 is a block diagram illustrating the configuration of a control unit in the ground device according to the embodiment.

FIG. 4 is a block diagram illustrating the configuration of the control unit 7 in the ground device 1 according to the embodiment.

As illustrated in FIG. 4, the control unit 7 in the ground device 1 includes an on-rail section detecting unit 71, a control information generating unit 72, and an information/signal conversion unit 73.

The on-rail section detecting unit 71 detects an on-rail section of a train on the route R based on the detection result of each train detection unit 3 and the train position signal received by each of the wayside radio sets $\mathbf{6}_1$ to $\mathbf{6}_n$. The on-rail section detected by this on-rail section detecting unit 71 is either one of the fixed sections B1 to Bm or a section smaller than the fixed section depending on the train (more specifically, the on-board device mounted on the train).

Figure 5A:
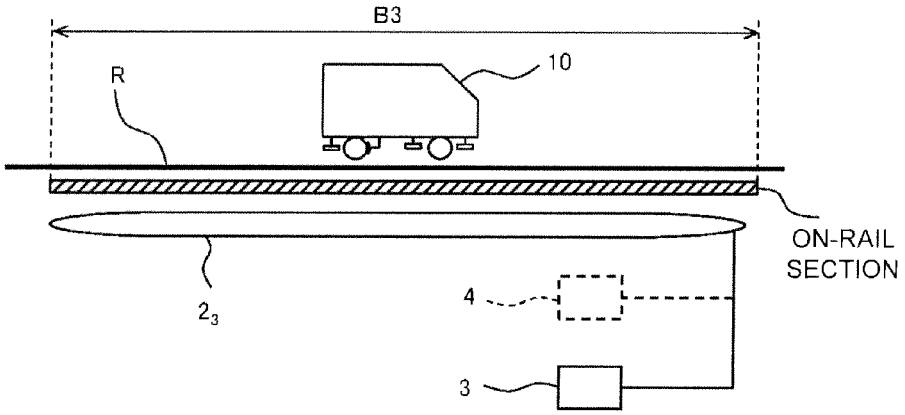
FIGS. 5A and 5B are diagrams for describing processing performed by the control unit.

For example, as illustrated in FIG. 5A, when the train 10 with the ATC/TD on-board device mounted thereon is present in the fixed section B3, a train detection unit 3 connected to a loop coils $\mathbf{2}_3$ detects that the train 10 is present on rails in the fixed section B3, and the detection result is output to the control unit 7. In this case, the on-rail section detecting unit 71 detects the whole of the fixed section B3 as the on-rail section.

Figure 5B:
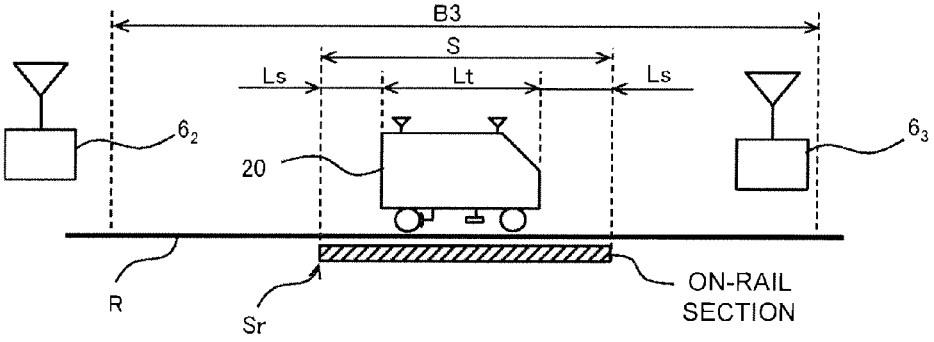

On the other hand, as illustrated in FIG. 5B, when the train 20 with the CBTC on-board device mounted thereon is present in the fixed section B3, the position of the train 20, i.e., a train position signal indicative of a specific position of the train 20 in the fixed section B3 is received by a wayside radio set $\mathbf{6}_2$ and/or a wayside radio set $\mathbf{6}_3$, and this train position signal is output to the control unit 7. In this case, the on-rail section detecting unit 71 detects, as the on-rail section, a section S (<fixed section B3) determined based, for example, on the position of the train 20, the length Lt of the train 20, and a preset given length (margin distance) Ls, rather than the whole of the fixed section B3. The given length (margin distance) Ls may be added only to the rear side of the train 20. Unlike the fixed sections B1 to Bm, this section S moves depending on the position of the train 20.

Here, the on-rail section detecting unit 61 determines the section S based on train position signals transmitted from the vehicle radio sets, but the vehicle radio sets may transmit information indicative of the section S by radio instead of or in addition to the train position signals.

The control information generating unit 72 generates two pieces of train control information based on the on-rail section detected by the on-rail section detecting unit. One is the stop section information and the other is the stop limit information. For example, when the whole of the fixed section B3 is detected as the on-rail section of the train 10 (see FIG. 5A), the control information generating unit 72 generates, as train control information for a train that follows the train 10, the stop section information indicating, as a stop section of the following train, a fixed section B2 located behind the fixed section B3 in the traveling direction of the train, and generates the stop limit information indicating, as a stop limit (stop position) of the following train, a rear position apart from the rear end of the fixed section B3 by a safe distance.

When the train 10 exists across the border between the fixed section B2 and the fixed section B3, for example, the control information generating unit 72 generates the stop section information indicating, as the stop section of the following train, a fixed section B1 located behind the fixed section B2, and generates the stop limit information indicating, as the stop limit (stop position) of the following train, a rear position apart from the rear end of the fixed section B2 by a safe distance.

On the other hand, when the section S smaller than the fixed section B3 is detected as the on-rail section of the train 20 (see FIG. 5B), the control information generating unit 72 generates, as train control information for a train that follows the train 20, the stop section information indicating, as the stop section of the following train, the fixed section B2 located behind the fixed section B3 including the section S in the traveling direction of the train, and generates the stop limit information indicating, as the stop limit (stop position) of the following train, a rear position apart from the rear end Sr of the section S by a safe distance.

When the train 20 exists across the border between the fixed section B2 and the fixed section B3, the rear end Sr of the section S is located in the fixed section B2. In this case, the stop section information indicating, as the stop section of the following train, the fixed section B1 located behind the fixed section B2 is generated, and the stop limit information indicating, as the stop limit (stop position) of the following train, a rear position apart from the rear end Sr of the section S by a safe distance is generated.

The information/signal conversion unit 73 converts train control information generated by the control information generating unit 72, i.e., the stop section information and the stop limit information, into different kinds of signals, respectively. Specifically, the stop section information is converted to a signal in a form capable of being received by the ATC/TD antennas 12*a* and 12*b* on the train side through the loop coils $\mathbf{2}_1$ to $\mathbf{2}_m$. On the other hand, the stop limit information is converted to a radio signal capable of being transmitted and received between the wayside radio sets $\mathbf{6}_1$ to $\mathbf{6}_n$ and the vehicle radio sets 22*a* and 22*b*. Since these signal forms are known, the description thereof will be omitted.

Then, the information/signal conversion unit 73 sets the signal obtained by converting the stop section information as the ATC signal and outputs the signal to an information transmission unit connected to intended loop coils as the train control signal for the train that follows the train 10 or the train 20, and sets the signal obtained by converting the stop limit information as the CBTC signal and outputs the signal to intended wayside radio sets as the train control signal for the train that follows the train 10 or the train 20.

Thus, even when the train traveling on the route R is either of the train 10 with the ATC/TD on-board device mounted thereon and the train 20 with the CBTC on-board device mounted thereon, the on-board device of the train receives the train control signal for the train to perform appropriate speed control and the like.

Although the case where the train 10 with the ATC/TD on-board device mounted thereon or the train 20 with the CBTC on-board device mounted thereon exists within the fixed section B3 and the case where the train exists across the border between the fixed section B2 and the fixed section B3 have been described, the same applies to a case where the train 10 or the train 20 exists in any other fixed section and a case where the train is located across the border between other two fixed sections.

According to the ground device 1 of the embodiment, even when the train 10 with the ATC/TD on-board device mounted thereon and the train 20 with the CBTC on-board device mounted thereon coexist on the route R, the position of each train on the route R can be detected. Then, the ground device 1 generates control information on each train based on the detected position of each train, converts the generated control information to a signal in a form capable of being received by the ATC/TD antennas and the vehicle radio sets, respectively, and transmits the signal. This allows both the train 10 with the ATC/TD on-board device mounted thereon and the train 20 with the CBTC on-board device mounted thereon to travel safely on the route R.

Furthermore, for example, when the train control system for a train line (zone) employing the ATC/TD system is changed to the CBTC system, if the ground device according to the embodiment is applied to a route of the train line (zone), a balance between commercial operations of trains with the ATC/TD on-board device mounted thereon and the adjustment of the CBTC system by trains with the CBTC on-board device mounted thereon can be achieved. This avoids the need to make the alteration of the vehicle twice as in the conventional manner, reducing time and effort significantly at system change.

In the embodiment described above, the train detection signal (TD signal) and/or the detection result of each train detection unit 3 and the train position signal correspond to "train position information" of the present invention, the stop section information and the stop limit information correspond to "train control information" of the present invention, the ATC signal and the CBTC signal correspond to "train control signal" of the present invention, and the fixed sections B1 to Bm correspond to "detection sections" of the present invention. Furthermore, the control unit 7 functions as "processing unit" of the present invention.

The above has described the ground device applied to a route on which a train with the ATC/TD on-board device mounted thereon and a train with the CBTC on-board device mounted thereon travel. However, the present invention is not limited thereto.

For example, it may be desired to permit a train with an on-board device for a first CBTC system (hereinafter called "first CBTC on-board device") mounted thereon and a train with an on-board device for a second CBTC system (hereinafter called "second CBTC on-board device") using radio different from the first CBTC system (for example, radio signal different in frequency band) to travel through the same zone. In such a case, after wayside radio sets for the first CBTC system and wayside radio sets for the second CBTC system are installed along a route in the zone, it is only necessary for the control unit 7 to perform the following processing.

The on-rail section detecting unit 71 detects an on-rail section of the train with the first CBTC on-board device mounted thereon based on a train position signal received by each of the wayside radio sets for the first CBTC system, and detects an on-rail section of the train on the route with the second CBTC on-board device mounted thereon based on a train position signal received by each of the wayside radio sets for the second CBTC system. Each on-rail section detected in this case is a section corresponding to the section S mentioned above.

The control information generating unit 72 generates control information on each train based on the on-rail section detected by the on-rail section detecting unit. The control information in this case generates the stop limit information in which a rear position apart by a safe distance from the rear end of the on-rail section detected by the on-rail section detecting unit 71 is set as the stop limit (stop position) of a train that follows the train located in the on-rail section.

The information/signal conversion unit 73 converts train control information generated by the control information generating unit 72, i.e., the stop limit information, into two radio signals of different kinds. One is a radio signal in a first frequency band used in the first CBTC system, and the other is a radio signal in a second frequency band used in the second CBTC system.

Then, as train control signals for a train that follows the train located in the on-rail section, the information/signal conversion unit 73 outputs the radio signal in the first frequency band to intended wayside radio sets for the first CBTC system, and outputs the radio signal in the second frequency band to intended wayside radio sets for the second CBTC system.

Thus, even when the train traveling on the route is either of the train with the first CBTC on-board device mounted thereon and the train with the second CBTC on-board device mounted thereon, where the second CBTC on-board device uses radio different from the first CBTC on-board device, the on-board device of the train receives the train control signal for the train to perform appropriate speed control and the like.

It should be noted that the entire contents of Japanese Patent Application No. 2011-217316, filed on Sep. 30, 2011, on which convention priority is claimed, is incorporated herein by reference.

It should also be understood that many modifications and variations of the described embodiments of the invention will be apparent to a person having an ordinary skill in the art without departing from the spirit and scope of the present invention as claimed in the appended claims.

What is claimed is:

1. A ground device that transmits a train control signal for a train to an on-board device mounted on the train, comprising:

an input unit capable of inputting first train position information and second train position information different in kind from each other;

a processing unit that detects a position of each of one or more trains traveling on a route based on the input first train position information and second train position information, generates control information on each of the trains based on the detected position of each of the trains, and converts the generated control information to a first train control signal and a second train control signal different in kind from each other; and a transmitting unit that transmits the first train control signal and the second train control signal to each of the trains.

2. The ground device according to claim 1, wherein the first train position information is information indicating that a train is present on rails in each detection section obtained by dividing the route into a plurality of sections, and the second train position information is information indicative of the position of a train on the route or information indicating that a train is present on rails in a section smaller than the detection section.

3. The ground device according to claim 1, wherein the first train position information is information detected through loop coils or track circuits provided on the route, and the second train position information is information transmitted from the onboard device by radio and received by any one of wayside radio sets which are installed along the route.

4. The ground device according to claim 3, wherein the first train control signal is a signal including the control information indicating that any of the detection sections is set as a stop section in which the train is to stop, and the signal is transmitted through the loop coils or the track circuits, and the second train control signal is a signal including the control information indicating that a stop limit, to which the train can travel, is set as a stop position, the signal being transmitted as a radio signal by any one of the wayside radio sets.

5. The ground device according to claim 1, wherein the first train position information is information for performing train control by a fixed block system, and the second train position information is information for performing train control by a moving block system.

6. The ground device according to claim 1, wherein the first train position information and the second train position information are pieces of information transmitted from the on-board device by radio in different frequency bands, and received by any one of wayside radio sets which are installed along the route, the first train control signal is a signal transmitted from the transmitting unit as a radio signal in a frequency band corresponding to the first train position information, and the second train control signal is a signal transmitted from the transmitting unit as a radio signal in a frequency band corresponding to the second train position information.

* * * * *